United States Patent [19]

Kunreuther

[11] 4,237,779

[45] Dec. 9, 1980

[54] AUTOMATIC ATTACHING APPARATUS

[75] Inventor: Steven Kunreuther, New York, N.Y.

[73] Assignee: Kunreuther & Beringhause, Carle Place, N.Y.

[21] Appl. No.: 14,264

[22] Filed: Feb. 22, 1979

[51] Int. Cl.[3] ..... B31F 7/00

[52] U.S. Cl. ..... 493/372; 227/30; 227/30

[58] Field of Search ..... 93/88, 87, 89–92; 227/25, 28, 29, 39–40, 50

[56] References Cited

U.S. PATENT DOCUMENTS

| | | | |
|---|---|---|---|
| 1,407,295 | 2/1922 | Parker | 227/50 |
| 3,103,666 | 9/1963 | Bone | 1/301 |
| 3,598,025 | 8/1971 | Cotton | 93/87 |
| 3,896,713 | 7/1975 | Mato | 93/88 |
| 3,985,067 | 10/1976 | Livio et al. | 93/88 |

OTHER PUBLICATIONS

TexPak, Inc. Brochure Re: Model Nos.: PS-100, PB-300, PS-500, PB-700, PS-600, PB-800, PS-200, PB-400, TexPak, Inc. 2 Voice Road, Carle Place, N.Y. 11514

*Primary Examiner*—James F. Coan
*Attorney, Agent, or Firm*—James & Franklin

[57] ABSTRACT

The apparatus is designed for automatic attachment of a header, a tag or the like to a softgoods article by means of a plastic fastener. A commercial fastener attacher of the non-automatic, hand-held variety is fixedly mounted on a support and has a stationary hollow needle through which the fastener is dispensed. Above the attacher is located a platform, movably mounted on the support, having an opening therein aligned with the axis of the needle. Spaced from the platform is a clamping member having a recess therein aligned with the axis of the needle. The operator inserts the header or tag and the article between the member and the platform and actuated the apparatus. The member moves towards the platform to clamp the header or tag and article in face-to-face relationship therebetween. Further movement of the member causes the clamped header or tag and article assembly to move relative to the attacher to position same on the needle. An attacher actuating mechanism, responsive to the movement of the platform, causes the attacher to dispense a fastener.

38 Claims, 4 Drawing Figures

FIG. 3
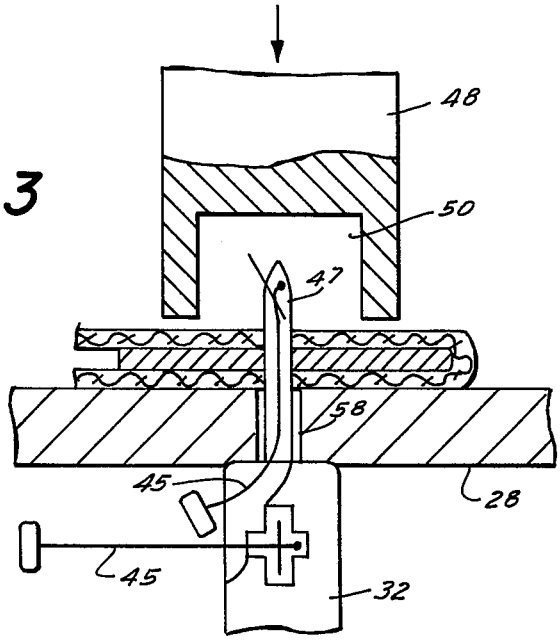
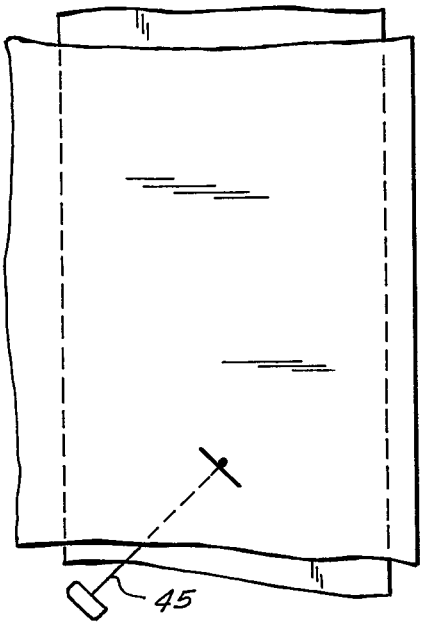
FIG. 4

AUTOMATIC ATTACHING APPARATUS

The present invention relates to automatic attaching apparatus and, more particularly, to an apparatus wherein the articles to be attached are clamped in face-to-face relation and, thereafter, positioned on the stationary needle of an attacher, as a unit.

Many softgoods articles such as towels, pot holders, and the like, are sold in supermarkets and similar retail outlets. Such items are commonly displayed on racks which are located in close proximity to the cash register for high visibility and easy access by the consumer.

Softgoods items of this type are, at present, often provided with a header attached directly to the item or to a plastic container in which the item is sold, with metal staples. A header is a piece of thin cardboard or the like which is folded over itself such that the article of software can be inserted between the folded parts in sandwich fashion. Stapling affixes one portion of the header to the front of the article or container and the other portion of the header to the rear of the article or container such that the article or container is firmly affixed between the folded portions of the header.

The header normally contains printed information relating to the article, such as the type of articles, the manufacturer, the price, and any other pertinent information. The header also has a hole or opening therein through which a metal prong or rod extending from the display rack may be received. In this manner, the article may be displayed in a highly visible manner and easily retrieved by a purchaser by simply lifting same off the metal prong or rod of the rack. The header, therefore, serves a dual purpose. It serves the purpose of a label because it contains the necessary printed information concerning the type of product, the manufacturer of the product, the price of the product, etc., and also serves as a means to permit hanging of the article on a rack for display purposes.

In certain instances, a header may comprise a single, non-folded paper or thin cardboard sheet and is, thus, very similar to what is commonly known as a tag. For the purposes of this disclosure, the word "header" is used herein to designate both the conventional folded type configuration and the single sheet tag-like configuration.

Increasing consumer resistance to the use of metal staples for attaching headers or the like to softgoods articles has developed for several reasons. Metal staples are difficult to remove. Because the staples are difficult to remove, the removal thereof often results in cut fingers or damage to the material of the article. In addition, unless the staples are properly affixed, that is, the sharp ends thereof are completely bent inwardly, they present a hazard to those who handle the merchandise and may cause tearing of adjacent merchandise during handling and shipping. Finally, metal staples cheapen the appearance of the product.

In order to overcome the above-stated disadvantages of metal staples, it has been suggested that conventional plastic fasteners be used instead of metal staples. Such plastic fasteners are currently widely utilized in the retail industry to attach tags and the like to garments, and are sold by the Dennison Manufacturing Company of Framingham, Mass. under the trademarks SWIFTACHMENT and SUPER SWIFTACHMENT, and by other manufacturers. These fasteners are sold in clips and each includes a T-bar end and a paddle end connected by a thin plastic filament. The fasteners are easy to remove by cutting the filament, and cannot injure fingers or damage the material of the article during handling or shipping. Further, the fasteners have a pleasing appearance and therefore, do not detract from the saleability of the product to which same is attached.

The great majority of such fasteners which are utilized are attached by means of a hand-held, manually actuated attacher or gun. The gun has a hollow needle which is adapted to penetrate the article and tag to which the fastener is to be attached. Once the needle is properly positioned, the attacher is actuated such that the T-bar end of the fastener is dispensed through the hollow needle until same is positioned on one side of the article and tag, with the paddle end of the fastener on the other side of the article and tag.

While hand-held, manually actuated attachers of this type are quite well adapted for certain applications, such as for attaching tags to garments, they are not readily usable for attaching headers and the like to articles of softgoods. First, the attachment of a header or the like to a softgoods article requires that the header and article be clamped together in face-to-face relation and retained as a unit as the needle penetrates the unit. This is normally difficult to accomplish with only a single hand, the other hand of the operator occupied by holding and actuating the attacher. Second, a reasonable amount of force is required to cause the needle to penetrate the cardboard layers of the header. Exerting such a force on the attacher normally causes the needle, once it penetrates the cardboard layers, to travel beyond the rear surface of the header creating a safety hazard because the needle can accidentally penetrate the fingers of the operator. Moreover, the use of such hand-held, manually actuated attachers is a relatively slow procedure which adds significantly to the labor costs involved in attaching the header. Thus, in spite of the fact that the fasteners and the hand-held, manually actuated attachers are quite reasonably priced, the use of same for attaching headers or the like to softgoods articles is contraindicated because of the increased labor costs and difficulties and dangers involved in the use of same.

These difficulties also exist when a conventional tag is affixed to a garment or the like. The present invention is equally suitable for attaching a conventional tag to a garment or in any tagging application where the exact penetration point of the needle into the garment is not critical. This type of tagging is performed on hosiery and many other types of goods.

There have been attempts to provide hand-held and non-hand-held automatically actuated attachers suitable for use in tagging operations. This equipment is, however, primarily designed for tagging articles made of difficult to penetrate materials, such as leather. For this reason, such equipment is quite complex and expensive and always requires a needle or an entire attacher which is movable to cause penetration of the garment to be tagged.

For instance, one type of mechanism, as exemplified by Mateo U.S. Pat. No. 3,896,713 entitled "Top Feeding Automatic Tag Attaching Machine" and Cotton U.S. Pat. No. 3,598,025 entitled "Tagging Machine", utilizes a movable carriage upon which the attacher is mounted such that the entire attacher may be moved relative to a support upon which the article to be tagged is placed. Thus, the attacher is moved relative to a stationary article, creating a safety hazard and often resulting in an enlarged opening in the article. Further, in this type of machine, there is no provision for clamping one article to the other in face-to-face relation, such that the needle can penetrate same as a unit. Thus, while this type of mechanism may be acceptable for some tagging operations, same is unsuitable for fastening headers or the like to softgoods articles.

Dennison Manufacturing Company of Framingham, Mass. sells a line of power tagging tools under the trademark POWER SWIFTACHER. This type of tool is specifically designed for attaching tags to articles composed of materials which resist needle penetration such as shoes, canvas bags, rugs, bolts of cloth, hides and gloves. This mechanism utilizes a powerful mechanism connected to the needle to develop the force necessary to push the needle through the article.

In such devices, the material to be tagged is placed between an abutting member and the nose of the tool. When the mechanism is actuated, the member moves towards the nose compressing and holding the material. At that point, a cylinder moves the gun body forward against the member and the needle is then mechanically moved forward relative to the gun body and through the material into the nose. As the needle is moved, the fastener is dispensed. Thus, the fastener is actually moving through the needle at the same time the needle is moving through the material.

This type of power tagging tool is specifically designed for use with materials which are quite hard in nature. When materials of this type are tagged, the combined movement of the needle and the fastener through the needle will normally not damage the article. However, when softgoods articles are used with such tagging tools, the combination of the moving needle and the moving fastener through the needle can severely damage the article by causing an enlarged hole or opening therein. Not only does the enlarged opening damage the article and, thus, make same unsaleable, the presence of an enlarged opening defeats the purpose of the fastener because the T-bar end of the fastener can easily pass through the enlarged opening and, thus, permits accidental or intentional removal of the header from the softgoods article.

Because of the complicated movements required in conventional power attaching tools, the mechanisms themselves are quite complex and, therefore, costly. In fact, such power tagging tools cost approximately eight to ten times as much as a hand-held, manually actuated fastener attacher. Moreover, the complexity of such tools results in high maintenance costs because of frequent breakdowns of the mechanism.

It is, therefore, a prime object of the present invention to provide automatic attaching apparatus wherein members to be attached together are clamped in face-to-face relation prior to being positioned on the needle.

It is another object of the present invention to provide automatic attaching apparatus wherein the members to be attached are positioned on the needle as a unit prior to actuation of the attacher.

It is a further object of the present invention to provide automatic attaching apparatus which utilizes a relatively inexpensive hand-held fastener attacher of conventional design.

It is still another object of the present invention to provide automatic attaching apparatus designed for attaching headers or the like to softgoods articles.

It is a still further object of the present invention to provide automatic attaching apparatus adapted to function rapidly in order to reduce labor costs.

It is a still further object of the present invention to provide automatic attaching apparatus which is composed of relatively simple, inexpensive and reliably functioning parts, so as to reduce the expenses associated with purchasing and maintaining the equipment.

In accordance with the present invention, an automatic apparatus for attaching first and second articles together is provided. The articles are attached together with a plastic fastener of the type adapted to be dispensed through a hollow needle of a conventional fastener attacher. The needle of the attacher is mounted on the attacher body and held stationary with respect thereto. The apparatus comprises a support means for mounting the attacher to the support. Means are provided for clamping the articles together in face-to-face relation, and for moving them, as a unit, relative to the attacher to position same on the needle. Means are also provided for actuating the attacher at the appropriate time.

The clamping and positioning means comprises first movable means and second movable means. The first means is movable between a first position, remote from the second means, so as to permit the articles to be placed therebetween, and a second position, relatively close to said second means, with the articles clamped in face-to-face relation therebetween. The first means is further movable between the second position and a third position wherein the retained articles are positioned as a unit on the needle of the attacher.

The movement of the first means between the second position and the third position causes the second means to move between an initial position, relatively remote from the attacher, and a final position, relatively close to the attacher.

Means are provided for moving the first means between the first, second and third positions. The attacher actuating means is preferably responsive to the movement of the clamping and positioning means. More specifically, the attacher actuating means comprises a switch which is in the path of movement of the clamping and positioning means and actuates the attacher as the second means is moved by the first means to the final position.

The first means comprises a member having a recess therein. The recess is aligned with the axis of the needle and adapted to at least partially receive the needle of the attacher therein when the body is moved to the third position. The second means comprises a platform and means for mounting the platform for movement relative to the support. The platform also has an opening therein which is aligned with the axis of the needle of the attacher and adapted to permit the needle to extend therethrough when the platform is moved to its final position.

The apparatus of the present invention is particularly suited for attaching a header or the like to a softgoods article with a plastic fastener. The operator simply holds the header and article between the member and platform and actuates the apparatus. Actuation of the apparatus first causes the member to move toward the platform so as to clamp the header and article in face-to-face relation therebetween. Further movement of the member causes the platform to move towards the attacher such that the attacher needle is inserted through the opening in the platform and the header and article are placed on the needle, as a unit. Cooperation of the member and the platform causes the header and article unit to be clamped in the proper position to permit penetration of the needle therethrough. After the needle penetrates the header and article unit, the movement of the platform actuates a switch which causes the attacher to dispense a fastener through the needle. The movement of the member is then reversed such that the spring loaded platform causes the attached header and article to be removed from the needle. Further movement of the member away from the platform releases the clamping action of the apparatus such that the attached header and article may be removed therefrom.

To these and other objects which may hereinafter appear, the present invention relates to an automatic attaching apparatus, as described in the following specification and set forth in the annexed claims, taken together with the accompanying drawings, wherein like numerals refer to like parts and in which:

FIG. 3 is an enlarged cross-sectional view of a portion of the apparatus of the present invention showing the needle after penetration through the header and article unit; and FIG. 4 is a top view of the header and article after same have been attached with a fastener.

Figure 1:
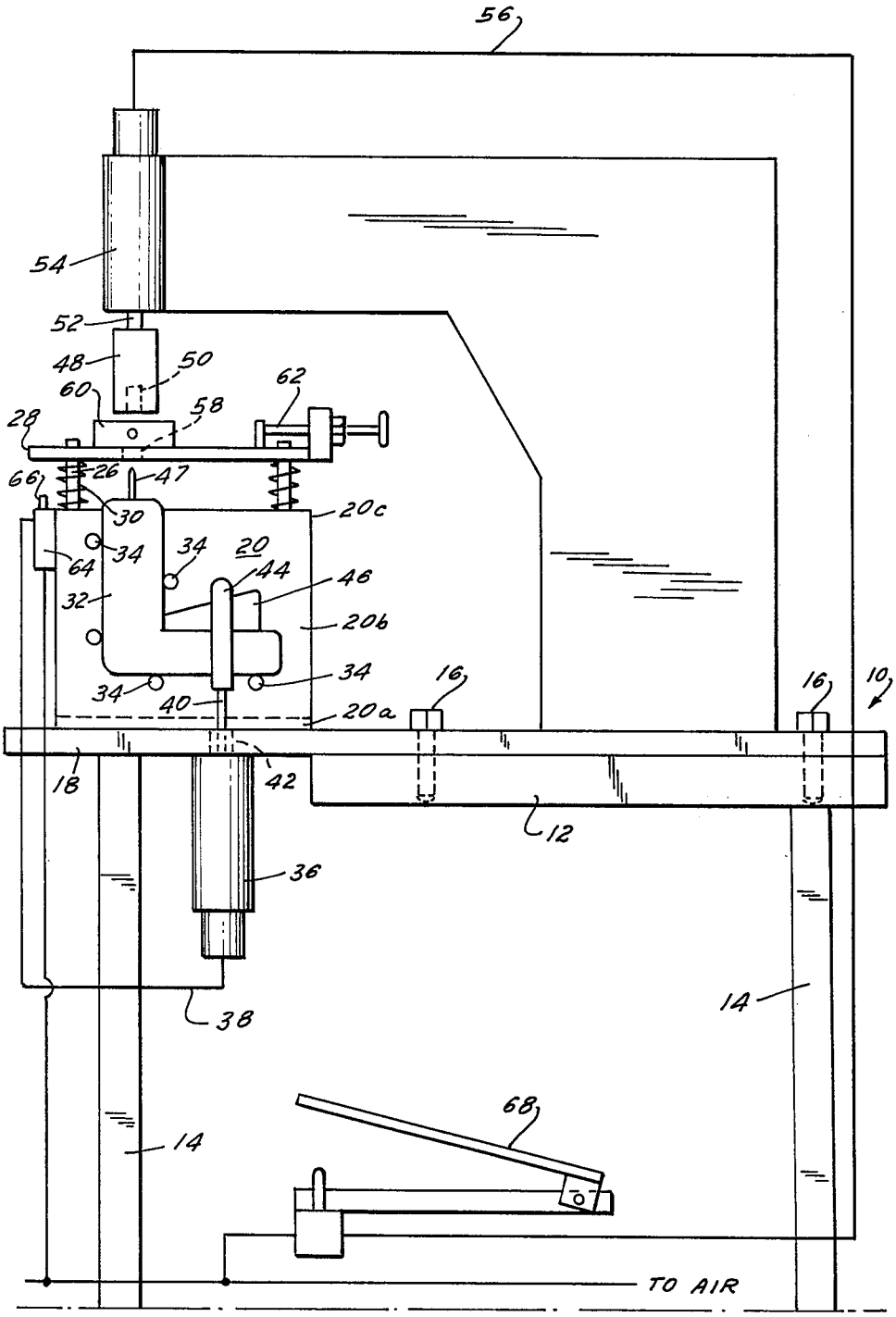
FIG. 1 is a side view of the automatic attaching apparatus of the present invention.
Figure 2:
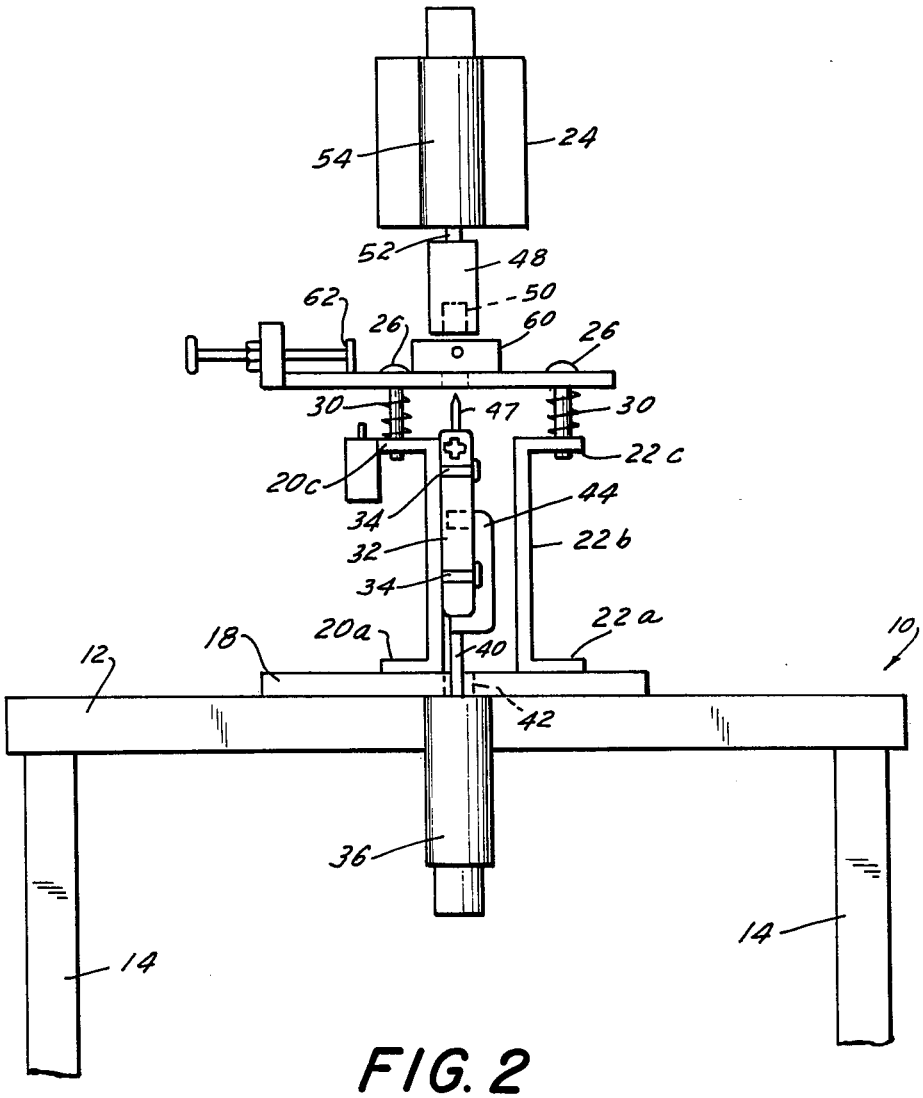
FIG. 2 is a front view of the automatic attaching apparatus of the present invention.

The apparatus, as illustrated in FIGS. 1 and 2, comprises a support including a generally tablelike base 10 including a generally planar horizontal member 12 and a plurality of vertically extending leg members 14. Affixed to the upper surface of planar member 12, by means of screws 16 or other conventional fastening members, is a substantially planar horizontal base 18 to which platform mounting brackets 20, 22 and an upstanding support member 24 are fixedly mounted.

As can best be seen from FIG. 2, each of the platform mounting brackets has a U-shaped configuration, when viewed edgewise. Each of the brackets 20, 22 has a horizontally extending bottom portion 20*a*, 22*a* which is fixedly mounted to base 18, an upstanding central portion 20*b*, 22*b*, and a top horizontally extending mounting portion 20*c*, 22*c*. Each of the top portions 20*c*, 22*c* are provided with a pair of spaced openings adapted to receive one end of a shaft or bolt 26 therein.

A platform 28 situated above brackets 20, 22 is provided with four openings therein, each adapted to receive one of the bolts 26. Surrounding each of the bolts 26, and inserted between the bottom surface of platform 28 and the top surfaces of portions 20*c* and 22*c* of brackets 20 and 22 are provided tension springs 30. Platform 28 is thus mounted to brackets 20, 22, in a manner permitting limited vertical movement. Movement of platform 28 relative to brackets 20 and 22 is guided by means of bolts 26, such that platform 28 always remains in a substantially horizontal plane as it is moved. Springs 30 serve to urge platform 28 towards its uppermost or initial position, as shown in FIGS. 1 and 2.

Mounted below platform 28, in a fixed position relative to the interior surface of bracket 20, is a conventional, manually actuatable fastener attacher 32, designed for hand-held operation. Attacher 32 is held in position with respect to the interior surface of bracket 20 by means of bolts 34 or the like. Attachers of the type illustrated are commercially available from the Dennison Manufacturing Company of Framingham, Mass., from Ben Clements and Sons of South Hackensack, N.J., and from other suppliers. Such attachers are of either the trigger grip type (illustrated in FIGS. 1 and 2), or of the scissor grip type (not shown).

The preferred embodiment of the present invention, as illustrated in FIGS. 1 and 2, discloses a trigger grip type attacher but the present invention should not be construed as being limited to the use of this specific design of attacher. Other types of attachers, such as the scissor grip type, could easily be utilized in the present invention by simple modifications of the attacher support and actuator mechanism, as would be readily understood by those skilled in the art.

Affixed to the undersurface of planar member 18 is a pneumatically operated cylinder 36 of conventional design. Cylinder 36 is connected, by means of a valve switch 64 to a source of compressed air (not shown). The piston within cylinder 36 is normally in a position spaced from the bottom of the cylinder. When valve switch 64 is actuated, the piston moves downwardly. The downward movement of the piston within cylinder 36 causes piston rod 40, extending through an opening 42 in member 18, to move downwardly, causing a trigger engaging member 44, connected to the end of rod 40 and in contact with trigger 46 of actuator 32, to move trigger 46 downwardly into a recess (not shown) in the handle of actuator 32 so as to actuate the attacher to dispense a fastener 45 through needle 47. When switch 64 is deactuated, the source of compressed air is disconnected from cylinder 36, which is then vented to the atmosphere. This permits a spring (not shown) located within the handle of attacher 32, to move trigger 46 to its original position, thereby causing the trigger engaging member 44 and piston rod 40 to move to their original positions. Alternatively, attacher 32 may be modified to delete the spring and a more powerful spring return cylinder or a double acting cylinder may be substituted for cylinder 36, if desired.

Suspended above the top surface of platform 28 is a clamping member 48. Clamping member 48 is preferably cylindrical in configuration and has, at the bottom thereof, an opening or recess 50. Clamping member 48 is suspended from a piston rod 52 which, in turn, is connected to a piston (not shown) located within a cylinder 54. Cylinder 54 is mounted on upstanding support 24.

Cylinder 54 is connected to a source of compressed air (not shown) by means of a conduit 56 through a footpedal valve switch 68. Switch 68, when actuated, causes cylinder 54 to be connected to a source of compressed air (not shown) so as to move the piston (not shown) situated therein downwardly. When switch 68 is deactuated, the source of compressed air is disconnected from cylinder 54 which is then vented to the atmosphere to permit a spring (not shown), located in the cylinder, to move the piston to its original uppermost position.

Platform 28 is provided with an opening or hole 58 therein which is in alignment with the axis of needle 47. Opening 58 permits needle 47 to be inserted therethrough when platform 28 is moved towards attacher 32. On the top surface of platform 28 are provided a pair of adjustable guides 60, 62 of conventional design which permit the operator to accurately position the articles to be attached with respect to the surface of platform 28. Guides 60 and 62 are made position-adjustable to permit attachment of articles of different sizes.

Valve switch 64 is mounted on the edge of top portion 20c of bracket 20 and has a pressure-sensitive actuator 66 situated in the path of movement of platform 28. When platform 28 is moved towards its final position, actuator 66 is depressed causing valve switch 64 to connect cylinder 36 to a source of compressed air by means of conduit 38. This causes the piston in cylinder 36 to move downwardly to actuate the attacher. When the movement of platform 28 releases actuator 66, valve switch 64 disconnects cylinder 36 from the source of compressed air permitting the piston therein to return to its original position. Valve switch 64 is a commercially available air valve such as Air Mite Valve No. MV2-A, or the equivalent.

It should be appreciated that switch 64 and, more particularly, actuator 66 may be positioned relative to platform 28 to actuate attacher 32 at any point along the path of travel of platform 28. For some relatively delicate materials, it is desirable to have the attacher actuated only when platform 28 is in its downmost position to prevent an enlarged opening in the article. For other, less delicate materials, the attacher may be actuated at an intermediate position of platform 28. For this reason, it may be desirable to mount switch 64 to bracket 20 in a fashion which permits adjustment of the position of the switch relative to the bracket.

Located under support 10 is foot actuated valve switch 68, such as is manufactured by Line Master Switch Corp. of Woodstock, Conn., as Catalog No. 3B-3082-S, or the equivalent. The actuation of switch 68 causes cylinder 54 to be connected to a source of compressed air by means of conduit 56 during the time when footpedal 68 is actuated. Actuation of switch 68 will cause member 48 to move downwardly. Release of switch 68 will cause conduit 56 to be disconnected from the source of compressed air, thereby permitting the piston within cylinder 54 to return to its original position.

In operation, the operator places the article and header to be attached thereto on the upper suurface of platform 28 with the edges thereof abutting position-adjustable guides 60 and 62. Once the header and article are properly positioned on platform 28, the operator actuates switch 68 by depressing the footpedal. The depression of the footpedal causes conduit 56 to be connected to a source of compressed air which, in turn, causes the piston within cylinder 54 to move downwardly towards platform 28. The downward movement of the piston within cylinder 54 causes piston rod 52 to extend, moving member 48 to a position wherein the article and header are clamped between the lower rim portion of member 48 and the top surface of platform 28.

Further movement of the piston within cylinder 54 causes the clamped article and header, as well as platform 28, to move downwardly towards attacher 32. As this takes place, needle 47 passes through opening 58 in platform 28, penetrates the clamped article and header, as a unit, and extends into recess 50 in the bottom of clamping member 48. As platform 28 is moved towards its final position, actuator 66 of switch 64 is depressed, causing conduit 38 to be connected to the source of compressed air, thereby actuating cylinder 36 to depress trigger 46 of attacher 32, causing a plastic fastener 45 to be dispensed through needle 47. This is illustrated in detail in FIG. 3.

After attacher 32 has been actuated, the operator releases footpedal on switch 68 causing cylinder 54 to be deactuated and to move member 48 to its original, uppermost position. The upward movement of member 48 permits platform 28 to move upwardly because of the spring loading thereof. The upward movement of platform 28 causes the needle to be withdrawn from the article and header to which the fastener has been attached. The upward movement of platform 28 also releases actuator 66 of switch 64 such that the cylinder 36 is deactuated and trigger 46 of attacher 32 returns to its original position. Once the needle has been withdrawn from the attached article and header and member 48 moved to its uppermost position, the article and header may be removed from the apparatus, such that a new article and header can be placed in position for attachment, or the article and header may be moved to another position relative to platform 28 and a second fastener attached thereto.

It will now be appreciated that the present apparatus clamps the article and header together in face-to-face relation prior to same being positioned on the needle. Further, the article and header to be attached together are positioned on the needle as a unit prior to actuation of the actuator. The apparatus is completely pneumatically actuated and utilizes a relatively inexpensive, commercially available, non-automatic fastener which is designed for hand-held use.

The apparatus is particularly suited for attaching headers or the like to softgood articles because of its clamping action and because the operation of the apparatus prevents enlarged holes from being imparted to the article. Moreover, the apparatus of the present invention is adapted to function rapidly in order to reduce labor costs and is composed of relatively simple, inexpensive and reliably functioning parts so as to reduce the expenses associated with purchasing and maintaining the equipment.

While only a single preferred embodiment of the present invention has been disclosed herein, it is obvious that many variations and modifications could be made thereto. For instance, two simultaneously actuated attachers, along with suitable support and actuating mechanisms, could be provided along with simultaneously movable dual clamping and positioning members, such that two fasteners could be attached simultaneously at spaced positions along the same header and article unit. It is intended to cover all of these modifications and variations which fall within the scope of the present invention, as defined by the following claims:

I claim:

1. An automatic apparatus for attaching first and second articles together with a fastener of the type adapted to be dispensed through the stationary hollow needle of a fastener attacher, said apparatus comprising a support, means for mounting an attacher to said support, means for clamping the articles together, at locations on opposite sides of the point thereon through which the needle will penetrate, and for moving same relative to the attacher to position same, as a unit, on the needle, and means for actuating said attacher.

2. The apparatus of claim 1, wherein said clamping and positioning means comprises first means and second means, said first means being movable between a first position, remote from said second means so as to permit the articles to be placed therebetween, and a second position, relatively closer to said second means with the articles clamped therebetween in face-to-face relation.

3. The apparatus of claim 2, wherein said first means is further movable between said second position and a third position wherein the articles are positioned on the needle of the attacher.

4. The apparatus of claim 3, wherein movement of said first means between said second position and said third position causes said second means to move between an initial position, relatively remote from the attacher, and a final position, relatively close to said attacher.

5. The apparatus of claim 3, further comprising means for moving said first means between said first, second and third positions.

6. The apparatus of claim 1, wherein said attacher actuating means is responsive to the movement of said clamping and positioning means.

7. The apparatus of claim 4, wherein said attacher actuating means is responsive to the movement of said second means.

8. The apparatus of claim 7, wherein said attacher actuating means actuates said attacher as said second means moves from said initial to said final position.

9. The apparatus of claim 8, wherein said attacher actuating means actuates said attacher when said second means is in said final position.

10. The apparatus of claim 2, wherein said second means comprises a platform and means for mounting said platform for movement relative to said support.

11. The apparatus of claim 10, wherein said platform has an opening therein, said opening being aligned with the axis of the needle of the attacher and adapted to permit the needle to extend therethrough.

12. The apparatus of claim 4, wherein said second means comprises a platform and means for mounting said platform for movement relative to said support.

13. The apparatus of claim 12, wherein said mounting means comprises means for guiding the movement of said platform relative to said support and means for biasing said platform towards said initial position.

14. The apparatus of claim 2, wherein said first means comprises a member having a recess therein, said recess being aligned with the axis of the needle and being adapted to at least partially receive the needle of the attacher therein.

15. The apparatus of claim 14, wherein said first means further comprises means for moving said member between said first and second positions.

16. The apparatus of claim 3, wherein said first means comprises a member having a recess therein, said recess being aligned with the axis of the needle and being adapted to at least partially receive the needle of the attacher therein.

17. The apparatus of claim 16, wherein said first means further comprises means for moving said member between said first, second and third positions.

18. The apparatus of claim 16, wherein said second means comprises a platform and means for mounting said platform for movement relative to said support.

19. The apparatus of claim 18, wherein said platform has an opening therein, said opening being aligned with the axis of the needle of the attacher and adapted to permit the needle to extend therethrough.

20. The apparatus of claim 19, wherein said mounting means comprises means for guiding the movement of said platform relative to said support and means for biasing said platform toward a position remote from said support.

21. The apparatus of claim 10, wherein said second means further comprises adjustable means for positioning the articles on said platform.

22. The apparatus of claim 10, wherein said attacher actuating means is responsive to the movement of said platform.

23. The apparatus of claim 22, wherein said attacher actuating means comprises valve means located in the path of movement of said platform and adapted to energize said attacher actuating means when said platform moves to a predetermined position relative to said support.

24. An automatic apparatus for attaching first and second articles together with a fastener of the type adapted to be dispensed through the stationary hollow needle of a fastener attacher, said apparatus comprising a support, means for mounting an attacher to said support, means for clamping the articles together in face-to-face relation, and for moving same relative to the attacher to position same, as a unit, on the needle, and means for actuating said attacher, said clamping and positioning means comprising first means and second means, said first means being movable between a first position, remote from said second means so as to permit the articles to be placed therebetween, a second position, relatively closer to said second means so as to clamp the articles therebetween in face-to-face relation, and a third position, wherein the articles are positioned on the needle of the attacher and further comprising means for moving said first means between said first, second and third positions.

25. An automatic apparatus for attaching first and second articles together with a fastener of the type adapted to be dispensed through a stationary hollow needle of a fastener attacher, said apparatus comprising a support, means for mounting an attacher to said support, means for clamping the articles together in face-to-face relation and for moving same relative to the attacher to position same, as a unit, on the needle, wherein said clamping and positioning means comprises first means and second means, said first means being movable between a first position, remote from said second means so as to permit the articles to be placed therebetween, and a second position, relatively close to said second means with the articles clamped therebetween in face-to-face relation, said first means comprising a member having a recess therein, said recess being aligned with the axis of the needle and being adapted to at least partially receive the needle of the attacher therein, and means for moving said member between said first and second positions, said member moving means comprising a pneumatic cylinder having an extendible piston rod to which said member is mounted, and means for energizing said cylinder, and means for actuating said attacher.

26. An automatic apparatus for attaching first and second articles together with a fastener of the type adapted to be dispensed through the stationary hollow needle of a fastener attacher, said apparatus comprising a support, means for mounting an attacher to said support, means for clamping the articles together in face-to-face relation, and for moving same relative to the attacher to position same, as a unit, on the needle, and means for actuating said attacher, said clamping and positioning means comprising first means and second means, said first means being movable between a first position remote from said second means, so as to permit the articles to be placed therebetween, a second position, relatively closer to said second means, so as to clamp the articles therebetween in face-to-face relation, and a third position, wherein the articles are positioned on the needle of the attacher, and wherein said movement of said first means between said second position and said third position causes said second means to move between an initial position, relatively remote from the attacher, and a final position, relatively closer to the attacher.

27. The apparatus of claim 26, wherein said attacher actuating means is responsive to the movement of said second means.

28. The apparatus of claim 27, wherein said attacher actuating means actuates said attacher as said second means moves from said initial to said final position.

29. The apparatus of claim 28, wherein said attacher actuating means actuates said attacher when said second means is in said final position.

30. The apparatus of claim 26, wherein said second means comprises a platform and means for mounting said platform for movement relative to said support.

31. The apparatus of claim 30, wherein said mounting means comprises means for guiding the movement of said platform relative to said support and means for biasing said platform towards said initial position.

32. An automatic apparatus for attaching first and second articles together with the fastener of the type adapted to be dispensed through the stationary hollow needle of a fastener attacher, said apparatus comprising a support, means for mounting an attacher to said support, means for clamping the articles together in face-to-face relation and for moving same relative to the attacher to position same, as a unit, on the needle, means for actuating said attacher, said clamping and positioning means comprising first means and second means, said first means being movable between a first position, remote from said second means so as to permit the articles to be placed therebetween, and a second position, relatively closer to said first means so as to clamp the articles therebetween in face-to-face relation, wherein said first means comprises a member having a recess therein, said recess being aligned with the axis of the needle and being adapted to at least partially receive the needle of the attacher therein.

33. The apparatus of claim 32, wherein said first means further comprises means for moving said member between said first and second positions.

34. An automatic apparatus for attaching first and second articles together with a fastener of the type adapted to be dispensed through the stationary hollow needle of the fastener attacher, said apparatus comprising a support, means for mounting an attacher to said support, means for clamping the articles together in face-to-face relation and for moving same relative to the attacher to position same, as a unit, on the needle, and means for actuating said attacher, said clamping and positioning means comprising first and second means, said first means being movable between a first position, remote from said second means so as to permit the articles to be placed therebetween, a second position, relatively closer to said second means so as to clamp the articles therebetween in face-to-face relation, and a third position, wherein the articles are positioned on the needle of the attacher, and wherein said first means comprises a member having a recess therein, said recess being aligned with the axis of the needle and being adapted to at least partially receive the needle of the attacher therein.

35. The apparatus of claim 34, wherein said second means comprises a platform and means for mounting said platform for movement relative to said support.

36. The apparatus of claim 35, wherein said first means further comprises means for moving said member between said first, second and third positions.

37. The apparatus of claim 35, wherein said platform has an opening therein, said opening being aligned with the axis of the needle of the attacher and adapted to permit the needle to extend therethrough.

38. The apparatus of claim 37, wherein said mounting means comprises means for guiding the movement of said platform relative to said support and means for biasing said platform toward a position remote from said support.

* * * * *